United States Patent [19]

Whelan

[11] 3,975,601

[45] Aug. 17, 1976

[54] ROTARY SWITCH ACTUATABLE TO GENERATE PULSES IN A SELECTED ONE OF TWO NODES

[75] Inventor: Robert D. Whelan, West Springfield, Mass.

[73] Assignee: General Instrument Corporation, Clifton, N.J.

[22] Filed: June 11, 1975

[21] Appl. No.: 586,079

[52] U.S. Cl. ..... 200/11 R; 200/30 R; 200/61.39; 200/153 LB

[51] Int. Cl.[2] ..... H01H 19/60; H01H 21/80; H01H 3/42

[58] Field of Search ..... 200/4, 5 R, 6 B, 7, 200/11 R, 11 E, 11 EA, 11 G, 11 J, 11 K, 19 R, 20–22, 30 R, 153 LB, 154, 155 R, 336, 61.39

[56] References Cited

UNITED STATES PATENTS

| | | | |
|---|---|---|---|
| 2,498,805 | 2/1950 | Gureusky | 200/155 R X |
| 2,874,237 | 2/1959 | Shlesinger, Jr. | 200/4 |
| 3,047,683 | 7/1962 | Shlesinger, Jr. | 200/4 |
| 3,428,765 | 2/1969 | Ludwig | 200/61.39 |

*Primary Examiner*—James R. Scott

[57] ABSTRACT

The switch housing has a recess with first and second spaced terminals mounted therein. A resilient conductive element is mounted for limited arcuate movement within the recess between a first position where the element is connected to the first terminal and the second position where the element is connected to the second terminal. A detent wheel is rotatably mounted in the recess and engages a protrusion on the element to move the element between the first and second positions to select one of the positions. A common terminal is spaced from the element at both positions thereof. The protrusion on the element is effective, upon further rotation of the detent wheel in the same direction, to reciprocate the element to contact the common terminal, thus intermittently completing the circuit associated with the selected position.

26 Claims, 7 Drawing Figures

FIG. 1
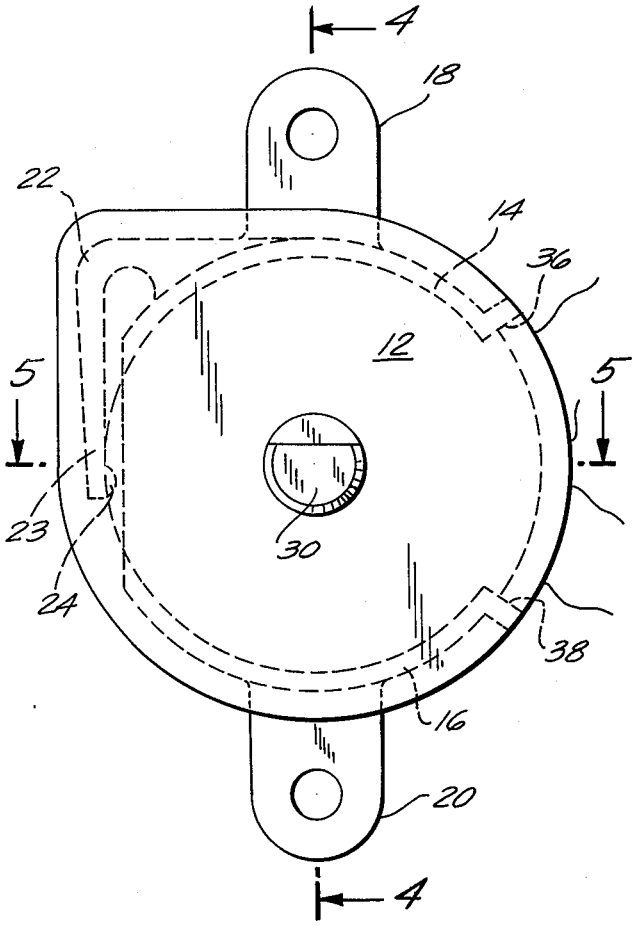
FIG. 2
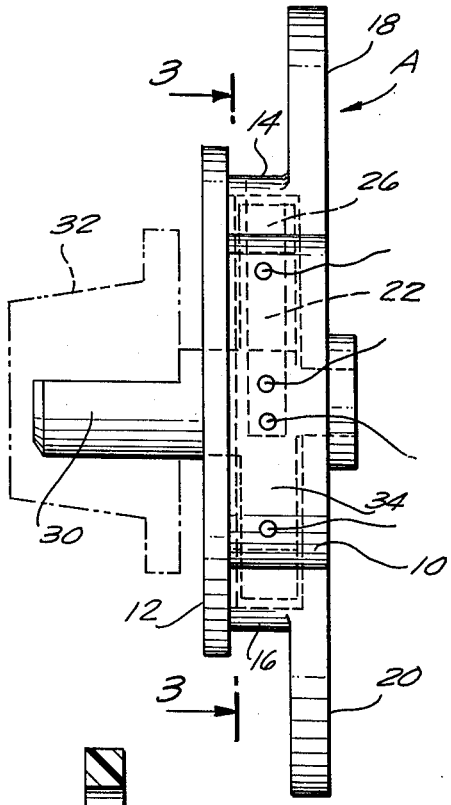
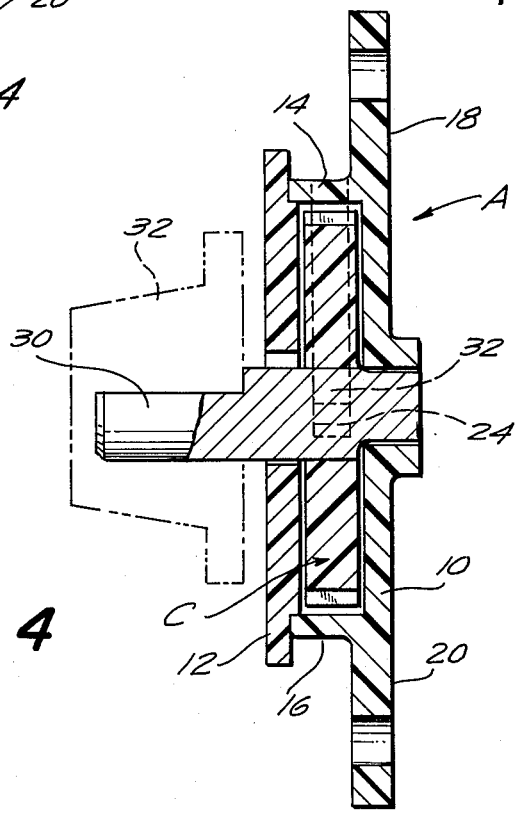
FIG. 4

ROTARY SWITCH ACTUATABLE TO GENERATE PULSES IN A SELECTED ONE OF TWO NODES

The present invention relates to a pulse generator and more particularly to a mechanical pulse generator capable of generating a series of pulses, the number of which is determined by the extent of actuation of an input member, in one of two modes, determined by the direction of actuation of the input member.

Certain types of electronic equipment require a series of pulses in order to control components thereof. For instance, pulses may be utilized to index an electronic counter, such as a binary counter. In addition, it may be desirable to have the same pulse generator generate pulses in two separate modes such that two separate electronic components can be controlled thereby. Alternatively, the pulses generated in separate modes may be utilized to control the same component in different directions. For example, pulses generated in two modes may be utilized to control separate binary counters, respectively, or if a reversible counter is utilized, the pulses in one mode may be utilized to index the counter in one direction whereas the pulses in the second mode may be utilized to index the counter in a different direction.

In addition to generating pulses in separate modes, it may also be necessary that the number of pulses, whichever mode is selected, be determined by the extent of actuation of the input member. For example, if the input member is a rotatable shaft, it may be desirable that the pulse generator generate a number of pulses which is a function of the degree of rotation of the shaft. Further, the mode may be selected by the direction of rotation of the shaft. Thus, the mode and number of pulses generated may be completely determined by the manipulation of a single input member.

Such a device is required in an electronic tuning system such as is disclosed in detail in application Ser. No. 565,121, filed Apr. 4, 1975, in the name of Louis-Pierre Zimmerman, entitled ELECTRONIC TUNING SYSTEM WITH ALTERABLE SEMICONDUCTOR MEMORY, and assigned to the assignee herein. In this instance, a mechanical pulse generator is utilized to fine tune an electronic tuning system.

Broadly considered, the tuning system consists of a memory which stores a digital word corresponding to each channel. Channel selection is accomplished by actuating the appropriate pushbuttons on a keyboard which causes the memory to be addressed. The digital word at the addressed location corresponding to the selected channel is sensed. The word is transferred to a digital to analog converter which converts the digital word to an analog voltage. This voltage is utilized to condition a varactor tuner to select the frequency corresponding to the channel which has been selected.

The digital to analog converter is of the pulse width modulation type which converts the digital word into a series of pulses, each having a duration or duty cycle which is a function of the digital word. This is accomplished by utilizing a pair of counters, one of which is set to a count which is a function of the digital word and the other of which is set to zero. The counters are simultaneously indexed and the overflow condition of each is sensed and utilized, respectively, to set and reset a bistable circuit such as a flip-flop. Thus, the pulse width of the pulse train generated is a function of the difference between the entries of the respective counters.

The mechanical pulse generator is connected to the counters such that the entry in one or the other of the counters may be altered. The mode of actuation of the pulse generator determines which counter entry is altered and the number of pulses generated by the counter determines the extent of alteration. Alterations in the counter entries change the difference between the entries in the counters and thus the analog voltage generated by the digital to analog converter. Alteration of the entry in one counter changes the magnitude of the analog voltage in one direction and alteration of the entry in the other counter changes the magnitude of the analog voltage in the other direction. In this manner, fine tuning is accomplished. In addition, the system provides for alteration of the data word in the addressed memory location in accordance with the changes in the counter entries after fine tuning has been completed such that the fine tuning setting is preserved for subsequent channel reselection.

It is important, in such a system, that the fine tuning member function in a manner similar to the fine tuning systems of conventional mechanical tuning systems. Thus, the fine tuning member must be actuatable in two directions to provide fine tuning both up and down the frequency scale. Further, the degree to which the tuner is fine tuned must be a function of the extent of actuation of the fine tuning member. This will provide the operator with the appropriate "analog feel" which he has come to expect from the fine tuning mechanism.

Moreover, the fine tuning mechanism must be made up of simple and reliable mechanical parts which are inexpensive to produce and easy to assemble. These parts must function reliably over the operational life of the system without jamming or substantial wear.

It is, therefore, a prime object of the present invention to provide a pulse generator which can be operated in one of two modes, depending upon the direction of actuation of the input member thereof.

It is a further object of the present invention to provide a pulse generator which will generate a number of pulses which is a function of the extent of actuation of the input member thereof.

It is another object of the present invention to provide a pulse generator which is comprised of simple mechanical parts which will operate reliably throughout the life of the generator.

It is still another object of the present invention to provide a pulse generator which is composed of inexpensive mechanical parts which can be easily assembled.

In accordance with the present invention, the pulse generator is provided having a housing with first and second spaced terminals mounted thereon. A conductive element is mounted for limited movement in a first sense relative to the housing between a first position wherein the element is operably connected to the first terminal and the second position where the element is operably connected to the second terminal. A member having a hill-and-valley surface is mounted in the housing for movement in a first and a second direction. Means operably connected to the element are provided which are engagable with the surface of the member to move the element between the first and the second position when the member is moved a given distance in the first and second direction, respectively. A third terminal is mounted on the housing at a position spaced from the element at both positions of the element. The means are effective, upon movement of the member beyond the given distance in the same direction, to move the element in a second sense, in accordance with the hills and valleys of the surface, to intermittently contact the third terminal.

The housing has an arcuate recess within which the resilient element is situated. The member, preferably in the form of a detent wheel, extends into the recess such that a protrusion on the conductive element is engagable with the detenting surface of the detent wheel. The detent wheel is rotatable in a clockwise or a counterclockwise direction.

The conductive element is moved within the recess as the protrusion engages the surface of the detent wheel such that it contacts one of the terminals when the detent wheel is rotated in one direction and the other terminal when the detent wheel is moved in the other direction. Further rotation in the same direction of the detent wheel causes the protrusion to move into and out from successive recesses on the detent wheel surface, thus causng a portion of the contact to reciprocate in a direction perpendicular to the direction of limited movement of the element.

That portion of the element which reciprocates is aligned with a common contact at both positions of the element such that it is caused to intermittently contact the common terminal. The number of times that portion of the element contacts the common terminal is determined by the degree of rotation of the detent wheel. Each time the element contacts the common terminal, a circuit is completed from the common terminal through the conductive element to the selected one of the first and second terminals which the element is contacting. Thus, the number of pulses generated is a function of the degree of rotation of the detent wheel and the circuit which is intermittently completed is determined by the direction of rotation of the detent wheel.

To the accomplishment of the above and to such other objects as may hereinafter appear, the present invention relates to a mechanical pulse generator as set forth in the appended claims and as described in the specification taken together with the accompanying drawings in which:

FIG. 1 is a front elevational view of the generator of the present invention;

FIG. 2 is a side elevational view of the generator of the present invention;

Figure 3A:
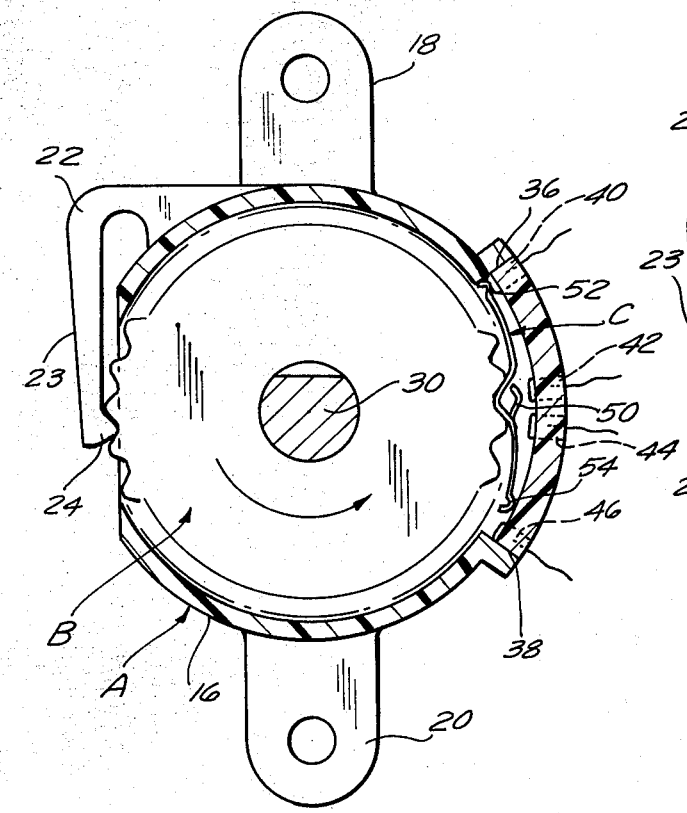
Figure 3B:
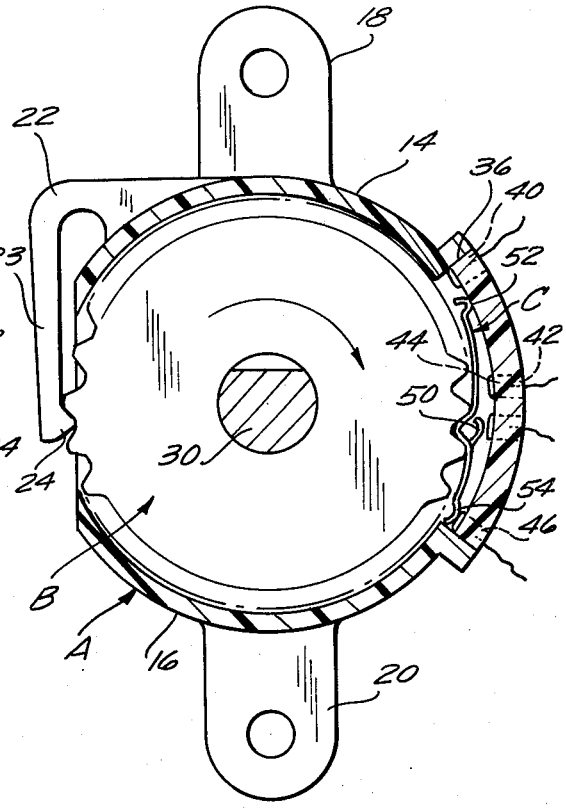
Figure 5:
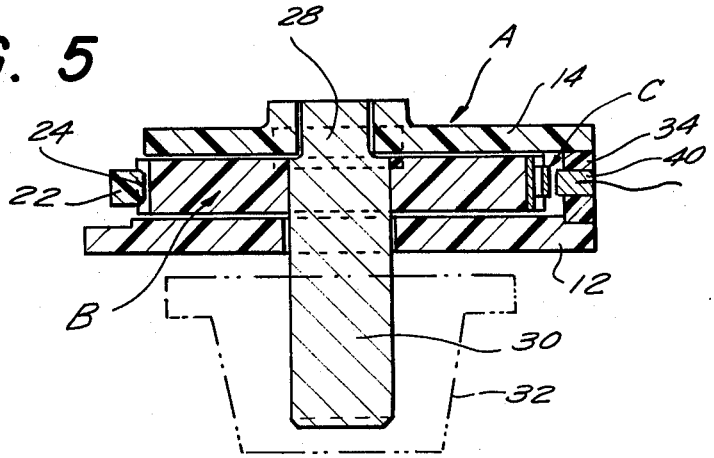

FIGS. 3A and 3B, respectively, are front cross-sectional views taken along line 3—3 of FIG. 2 of the generator of the present invention showing the conductive element in two different positions;

FIG. 4 is a side cross-sectional view taken along line 4—4 of FIG. 1;

FIG. 5 is a top cross-sectional view taken along line 5—5 of FIG. 1; and

Figure 6:
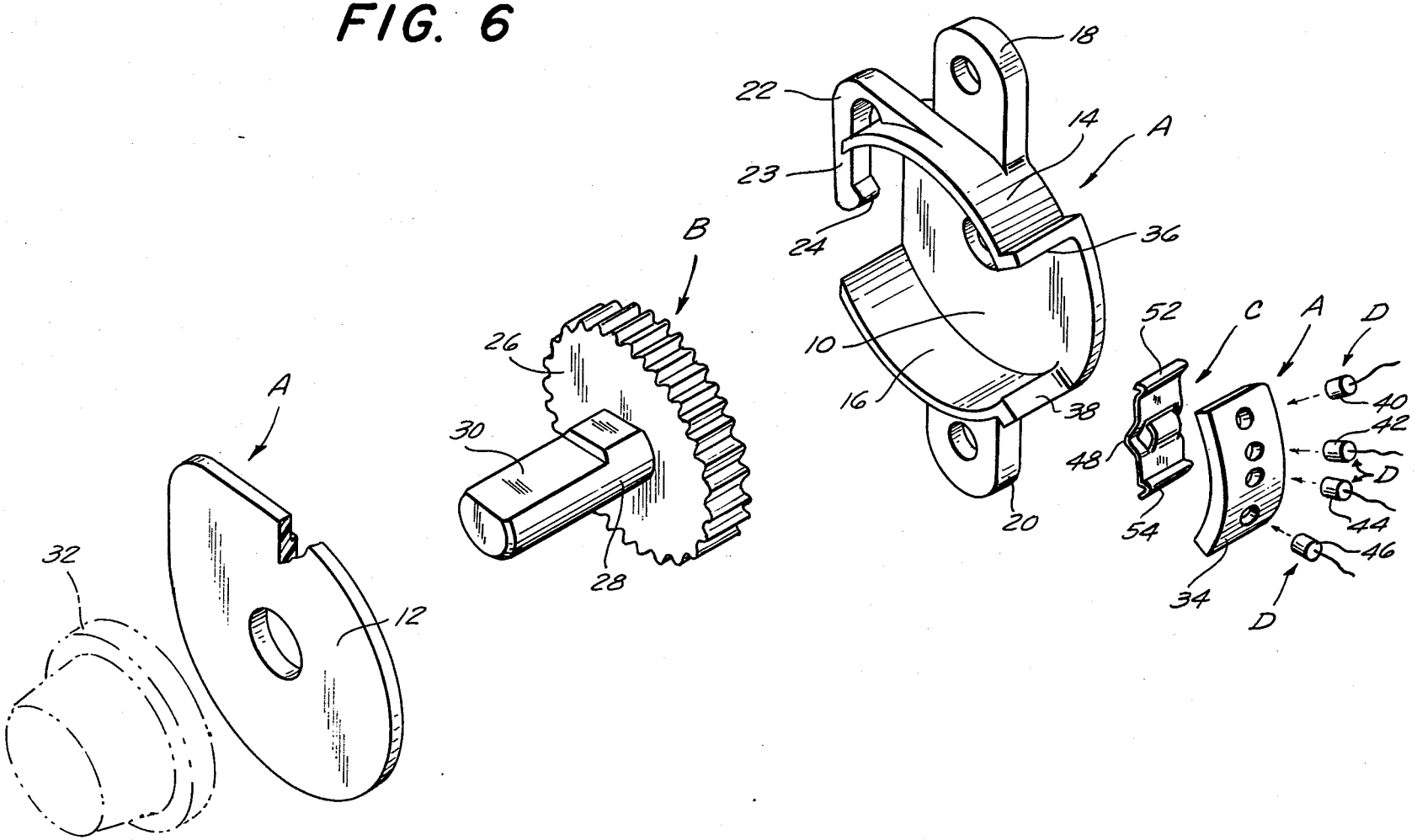

FIG. 6 is an exploded isometric view of the generator of the present invention.

As seen in FIG. 6, the present invention comprises a housing, generally designated A, which forms a recess into which an input member, generally designated B, is movably mounted. A conductive element, preferably made of resilient material, generally designated C, is situated within housing A adjacent to input member B. The wall of housing A adjacent element C is provided with a number of apertures into which a number of terminals, generally designated D, are situated.

More specifically, housing A comprises generally circular rear and front walls 10, 12. Oppositely facing convex top and bottom sections 14 and 16, respectively, are interposed between rear wall 10 and front wall 12 to form an enclosure, as seen in FIG. 1. Convex sections 14 and 16 are shorter than half of the circumference of the rear and front walls thereby leaving openings on each side of the enclosure. Extending vertically from the top and bottom of rear wall 10 are a pair of lugs 18, 20, each having an aperture such that the housing may be affixed to the chassis of a TV set or the like by means of a pair of screws or rivets (not shown).

Extending laterally from top section 14 is a detent arm 22 having a vertical section 23 upon which is mounted a protrusion 24 in alignment with the opening between sections 14 and 16 on the (left, as seen in the drawings) side of the housing. Arm 22 is preferably integral with the housing and is made of a material which permits a certain amount of flexibility thereof. Projection 24 is formed to cooperate with the hill-and-valley surface of a detent wheel 26 which forms a portion of input member B.

Detent wheel 26 is fixedly mounted on a shaft 28. Rear wall 10 and front wall 12 are each provided with an aperture through which shaft 28 extends. When assembled, detent wheel 26 is situated within housing A such that the detent surface thereof is aligned with projection 24. The detent surface and projection 24 cooperate in the well-known detent fashion as the wheel is moved relative to the protrusion.

The forward portion 30 of shaft 28 extends beyond front wall 12 of housing A to permit mounting of a knob 32 thereon. Rotation of knot 32, in turn, rotates shaft 28 and detent wheel 26 such that the wheel rotates intermittently because of the detenting of detent arm 24.

A generally convex side section 34, which also forms a portion of housing A, is mounted on the side of housing A between radial portions 36, 38 projecting from sections 14 and 16, respectively. Section 34 has four apertures therein into which terminals 40, 42, 44 and 46 are mounted.

Conductive element C is situated within an arcuate recess formed between detent wheel 26, section 34, projection 36 and projection 38. The distance between projections 36 and 38 is greater than the length of conductive element C such that limited movement of conductive element C is possible within the arcuate recess in which it is situated. Projections 36 and 38 define the range of this limited movement.

Conductive element C comprises a pair of projections 48 and 50 which extend in opposite directions from the mid-section thereof. On either end of conductive element C are situated additional terminal contacting projections 52 and 54 which are formed to contact terminals 40 and 46, respectively, as described in detail below.

Terminals 40 and 42 form a first terminal pair. Terminals 44 and 46 form a second terminal pair. Each terminal pair is connected to a signal source (not shown) such that when the connection between the terminals in the terminal pair is achieved, the circuit which contains that terminal pair is completed and the source is connected to whatever signal processing equipment is utilized in conjunction with the generator. Thus, each time conductive element C contacts both terminals 40 and 42, a pulse is generated on one circuit.

In a similar manner, when element C contacts both terminals 44 and 46, a pulse is generated on a second circuit. Terminals 42 and 44 may be connected together and thus may be considered the input or common terminals. It should be noted that these terminals could be replaced by a single elongated terminal, if desired. Terminals 40 and 46 are connected to their respective circuits and thus may be considered output terminals.

The direction of rotation of knob 32 determines which of the circuits will be completed. The counterclockwise rotation of knob 32 causes shaft 28 and detent wheel 26 to rotate in a counterclockwise direction. The rotation of detent wheel 26 is intermittent because of the coaction of the detent surface thereof with projection 24 of detent arm 22. Projection 48 on conductive element C engages the detent surface of detent wheel 26 thus causing conductive element C to move along with detent wheel 26 until the outer face of projection 52 on conductive element C abuts the interior surface of projection 36 on housing A. FIG. 3A shows conductive element C in this position.

When conductive element C is in its uppermost position, the tip of projection 52 thereon is operatively connected to terminal 40. However, because the length of conductive element C is shorter than the distance between terminals 40 and 46, projection 54 on conductive element C will not contact terminal 46 when conductive element C is in this position.

Further rotation of knob 32 in a counterclockwise direction causes detent wheel 26 to continue to rotate. Element C, however, can move no further in this direction because of the confines of projection 36; thus projection 48 on conductive element C reciprocates (because of the resiliency of element C) in accordance with the contours of the hill-and-valley surface of detent wheel 26 as the surface moves relative thereto. This reciprocation is in a direction which is radial with respect to detent wheel 26 and substantially perpendicular to the movement of element C within the arcuate recess.

When conductive element C is in the position shown in FIG. 3A, projection 50, which extends in the opposite direction from projection 48 is aligned with but not contacting terminal 42. However, as projection 48 is reciprocated, projection 50 is also reciprocated and the movement thereof is sufficient such that when projection 48 is at the apex of one of the undulations on detent wheel 26, projection 50 is in contact with terminal 42. This permits the circuit of which terminals 40 and 42 form a part to be intermittently completed.

If the direction of rotation of input member B is changed, the position of conductive element C will likewise change. Specifically, if knob 32 is rotated in the clockwise direction, conductive element C will be moved to its lower position, as shown in FIG. 3B, because of the engagement of projection 48 on conductive element C with one of the recesses on detent wheel 26. In this position, the outer face of projection 54 on the lower end of conductive element C abuts the interior surface of projection 38 on housing A and the tip of projection 54 contacts terminal 46. Further, projection 50 is aligned with terminal 44 such that further rotation in a clockwise direction of input member B causes projection 48 to reciprocate in accordance with the contours of the detent surface of detent wheel 26 and thus causes projection 50 to intermittently contact terminal 44. This causes the circuit of which terminals 44 and 46 form a part to be intermittently completed.

It can therefore be seen that the present invention is a pulse generator capable of generating pulses on one of two circuits in accordance with the direction of actuation of the input member. Further, the number of pulses generated is a function of the extent of rotation of the input member. Thus, when utilized as a fine tuning member, fine tuning in either direction can be achieved and the member provides "analog feel" such that the extent of fine tuning is a function of the amount of actuation of the input member. Moreover, the generator is comprised of simple, easily assembled parts which may be manufactured and assembled inexpensively and which will function reliably throughout the life of the generator.

While only a single embodiment of the present invention has been described herein for purposes of illustration, it is obvious that many modifications and variations can be made thereon. It is intended to cover all of these variations and modifications which fall within the scope of the invention as defined by the appended claims.

What is claimed is:

1. A pulse generator comprising a housing having first and second spaced terminals mounted thereon, a conductive element mounted for limited movement in a first sense relative to said housing between a first position wherein said element is operatively connected to said first terminal and a second position wherein said element is operatively connected to said second terminal, a member having a hill-and-valley surface mounted on said housing for movement in a first and a second direction, means operatively connected to said element engagable with said surface to move said element between said first and said second position when said member is moved a given distance in said first and said second direction, respectively, a third terminal mounted on said housing at a position spaced from said element at both positions of said element, said means being effective, upon movement of said member beyond said given distance in the same direction, to move said element in a second sense, in accordance with the undulations of said surface, to intermittently contact said third terminal.

2. The generator of claim 1 wherein the distance between said first and said second terminals is greater than the length of said element.

3. The generator of claim 1 wherein said element is resilient and said means comprises a first protrusion extending toward and engagable with said surface.

4. The generator of claim 1 wherein said third terminal is located between said first and said second terminals and further comprising a second protrusion on said element extending toward and intermittently engagable with said third terminal, said protrusion being aligned with said third terminal at both positions of said element.

5. The generator of claim 1 further comprising detent means cooperating with said hill-and-valley surface.

6. The generator of claim 1 wherein said member is rotatable and wherein said element moves in said first sense substantially tangentially thereto and said means moves in said second sense substantially radially thereto.

7. The generator of claim 1 wherein the movement of said element in said first sense is substantially perpendicular to the direction of movement of said means in said second sense.

8. A pulse generator comprising a housing, first and second spaced terminals mounted on said housing, a resilient conductive element mounted for limited movement in a given direction relative to said housing between first and second positions in which said element is operatively connected to said first and second terminals, respectively, a third terminal normally spaced from a portion of said element in both of said positions, means engagable with said element for moving said element in said given direction, said means being effective to move said portion of said element in a direction substantially perpendicular to said given direction to cause said portion to intermittently contact said third terminal.

9. The generator of claim 8 wherein said means is effective to reciprocate said portion only after said element has been moved to one of said first and second positions.

10. The generator of claim 8 wherein said means has a hill-and-valley surface and is rotatably mounted on said housing.

11. The generator of claim 8 wherein said means is engagable with said portion.

12. The generator of claim 10 wherein said means is rotated for a given distance in said first direction to position said element and wherein further movement in the same sense causes reciprocation of said portion.

13. The generator of claim 8 wherein said housing comprises means for limiting the movement of said element.

14. The generator of claim 13 wherein said movement limiting means comprises a pair of spaced surfaces between which said element is movable.

15. The generator of claim 8 wherein said housing comprises an arcuate recess into which said element is received.

16. The generator of claim 15 wherein said element is movable within said recess.

17. The generator of claim 8 wherein said element comprises a body portion and a pair of protruding portions.

18. The generator of claim 17 wherein said protruding portions extend in opposite directions.

19. The generator of claim 17 wherein said body portion is elongated and further comprises terminal contacting means on each end thereof.

20. The generator of claim 8 wherein said third terminal comprises first and second parts, said first and second parts being spaced from each other a distance approximately equal to the amount of limited movement of said element.

21. The generator of claim 20 wherein said element comprises a body portion and a pair of protruding portions.

22. The generator of claim 21 wherein one of said protrusions is aligned with said first part when said element is in said first position and said second part when said element is in said second position.

23. The generator of claim 22 wherein said housing comprises an arcuate recess into which said element is received.

24. The generator of claim 23 wherein said element is movable within said recess.

25. The generator of claim 24 wherein said terminals are mounted in the wall of said recess.

26. A pulse generator having an input terminal and first and second output terminals, a conductive element movable in a first direction relative to said terminals between a first position wherein said element is operatively connected to one of said output terminals and a second position wherein said element is operatively connected to the other of said output terminals, means operatively engaging said element and effective, upon actuation thereof in a given sense, to move said element in said first direction to one of said first and second positions, said means being effective, upon further actuation thereof in said given sense, to reciprocate said element in a second direction substantially perpendicular to said first direction, to additionally intermittently operatively connect said element to said input terminal.

* * * * *